United States Patent [19]

Teichler et al.

[11] Patent Number: 4,775,330

[45] Date of Patent: Oct. 4, 1988

[54] CABLE CONNECTING DEVICE

[75] Inventors: Heide Teichler; Wolfgang Radelow, both of Berlin, Fed. Rep. of Germany

[73] Assignee: Krone AG, Fed. Rep. of Germany

[21] Appl. No.: 123,120

[22] Filed: Nov. 20, 1987

[30] Foreign Application Priority Data

Nov. 21, 1986 [DE] Fed. Rep. of Germany ..... 3639793

[51] Int. Cl.[4] ..... H01R 4/24

[52] U.S. Cl. ..... 439/395

[58] Field of Search ..... 439/391–422

[56] References Cited

U.S. PATENT DOCUMENTS

| | | | |
|---|---|---|---|
| 3,835,444 | 9/1974 | Plana et al. | 439/392 |
| 4,037,905 | 7/1977 | Lucas | 439/395 |
| 4,326,767 | 4/1982 | Selbernagel et al. | 439/392 |

*Primary Examiner*—Joseph H. McGlynn

*Attorney, Agent, or Firm*—McGlew and Tuttle

[57] ABSTRACT

A cable connecting element, in particular a dropwire cable connecting element for double-wire dropwire cables comprises an upper and a lower part and of two connecting elements each moving two cutting and clamping contacts. This cable connecting element is intended to allow, with economic manufacture, an electrical connection between two double-wire dropwire cables, without removing their insulations from each other and without the distance between the wires being identical. The invention provides both in the upper part and in the lower part guide channels for accommodation of the double-wire cables into which their narrow sides are inserted. The guide channels of upper part and lower part have one connecting element, each with cutting and clamping contacts which penetrates the narrow slides of the respective incoming and outgoing double-wires and contact and connect the respective wires of both cables electrically.

13 Claims, 2 Drawing Sheets

CABLE CONNECTING DEVICE

FIELD AND BACKGROUND OF THE INVENTION

This invention relates in general to cable connectors and in particular to and useful method and apparatus for connecting double-wire dropwire cables.

A cable connecting element is known from U.S. Pat. No. 4,062,615, and it is provided with several connecting elements for contacting a multi-wire flat cable. The individual wires of the flat cable being arranged side by side have a common insulation surrounding the electricity conductive wires. The two ends of the incoming and outgoing flat cables to be connected are placed in the lower part of the cable connecting element. Contact is performed by the multitude of connecting elements arranged side by side in the upper part of the cable connecting element. The connecting elements are provided with cutting and clamping contacts which penetrates with cutting and clamping contacts each from above the insulation of the flat cable and effect electrical contact between the respective wires of the incoming and of the outgoing flat cables to be connected. For this, high press-in forces are required, in order to cut simultaneously the insulation of the multitude of wires of the two flat cables to be connected. Further, it is necessary that the spacing of the cutting and clamping contacts arranged side by side is accurately identical to the spacing of the wires of both flat cables. Another disadvantage is that the known cable connecting element cannot be used for dropwire cables. In particular double-wire dropwire cables, because dropwire cables have a particularly thick insulation, which normally cannot be penetrated by the cutting and clamping contacts. Thus it is necessary up to now to separate the two wires of a double-wire dropwire cable with the respective insulation from each other, in order to connect the two wires of the incoming double-wire dropwire cable with the two wires of the outgoing double-wire dropwire cable. Further there is the problem when connecting double-wire dropwire cables that the wires have no defined spacing to each other.

SUMMARY OF THE INVENTION

The invention provides an economic cable connecting element which allows the electrical connection between two double-wire dropwire cables, without the two wires with their thick insulations having to be separated from each other and without the spacings between the wires of the double-wire dropwire cables having to be accurately identical to each other.

With the invention it is achieved that the double-wire dropwire cables pressed-in on their narrow sides into the guide channels of upper and lower part are cut laterally on their narrow sides. In doing so, the insulation of the wires arranged above the double-wire dropwire cable is cut by the cutting and clamping contacts of the connecting element arranged in the upper part of the cable connecting element. The insulation of the wires arranged below of the double-wire dropwire cable is cut by the cutting and clamping contacts of the connecting element arranged in the lower part of the cable connecting element, and their respective wires are electrically contacted and are connected to each other. As the cutting and clamping contacts penetrate on both sides of the center axis of the double-wire dropwire cables, different spacings of the two wires will not effect the switch-on procedure and the contact connection between the wires and the cutting and clamping contacts of the connecting elements. Another advantage is that the upper and the lower part and the connecting elements arranged in the upper and lower part can be designed absolutely identical in construction, such that, by this, a considerable economic advantage is achievable.

Further advantageous embodiments of the invention include, e.g., the guide channels formed in U-shape, the incoming and outgoing double-wire dropwire cables inserted into the guide channels being each deflected by approximately 180° in the respective guide channels, whereby a strain relief of the double-wire dropwire cables is obtained.

Accordingly, it is an object of the invention to provide a method of electrically connecting two electrical dropwire cables each of which have a narrow top and bottom ends with upper and lower contact wires arranged in the insulation one above the other between the upper and lower ends and using a connecting body which has upper and lower interengaging parts each of which has a connecting element with two spaced apart upstanding electrical contacts with cutting and connecting elements which include cutting edges capable of cutting through the insulation of the cable and the vertically extending receiving slot of a width smaller than the diameter of the contact wires and which comprises placing the two dropwire cables into the connecting body so that each is oriented over and pressed against the respective cutting edge and so as to effect the cutting of the insulation up to the lower cutting wire and the engaging of the cutting wire into the receiving slot to cause the wire of each cable which is to be connected to the wire of the other cable to enter the slot and make contact with the cutting and connecting contacts and become electrically connected together through said cutting and connecting contacts, and which method may further include placing the upper part of a connecting body onto the lower part so as to effect the cutting of the insulation of each cable downwardly into the upper wire so that the two cables upper wire are interconnected electrically.

A further object of the invention is to provide a cable connecting device for connecting incoming and outgoing double-wire dropwire cables which have narrow top and bottom ends and which comprises an upper and lower part of two connecting elements with two spaced apart cutting and clamping contacts each disposed in both said upper and lower parts, said upper and lower parts having guide channels of a size for accommodation of the double-wire dropwire cables narrow ends and with a connecting element having two spaced apart cutting and clamping contacts being arranged in each of said upper and lower parts, said contacts each having a cutting penetrating into the narrow sides of both incoming and outgoing double-wire dropwire cables and contacting electrically their wires.

A further object of the invention is to provide a device for electrically connecting two electric double-wire dropwire cables which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
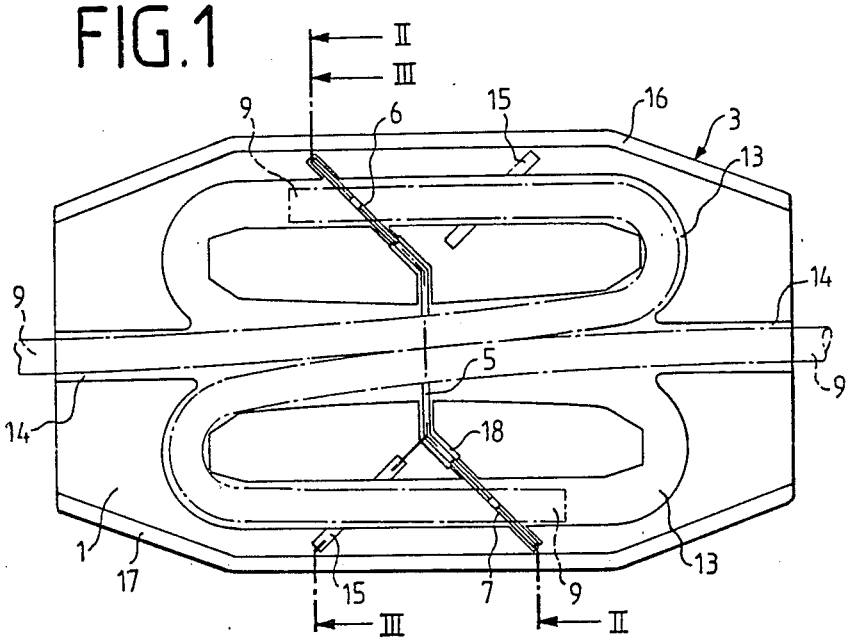
FIG. 1 is a top view of the lower part of a first embodiment of a cable connecting element constructed in accordance with the invention.

Referring to the drawings in particular, the invention embodied therein comprises a method and apparatus for electrically connecting at least one of two lower and upper electrical wires 11 and 12 of dropwire 9,9 which may be accomplished in a simple manner using a basic body generally designated 1 which has upper and lower parts 2 and 3 which when fitted together will effect contact through a contact connecting element 4 between the two lower wires of one cable and the two upper wires of the other cable.

Figure 2:
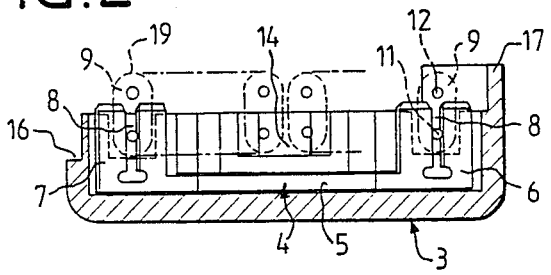
FIG. 2 is a section taken along the line II—II of FIG. 1.
Figure 3:
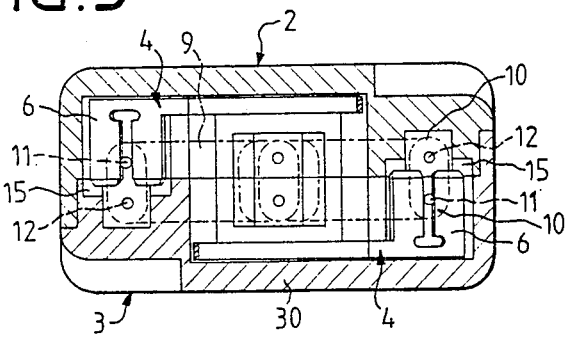
FIG. 3 is a section taken along the line III—III of FIG. 1 through both the lower and upper part.

The cable connecting element comprises, in the first embodiment shown in FIGS. 2 to 3, an upper part 2 and a lower part 3 being of the same construction as the upper part 2. In the following, only the lower part 3 shown in FIG. 1 is described. The lower part 3 comprises a plate-type basic body 1 with tapered side edges. On the inner side of the basic body 1, two O-shaped section guide channels 13 are provided forming together substantially the shape of a numeral "8". Further, another central guide channel 14 is arranged centrally and extrudes longitudinally. The guide channel 14 extends accurately through the central area of the 8-shaped guide channels 13. The guide channels 13 and 14 are designed in the form of grooves in the basic body 1, the groove in the central area of the 8-shaped guide channels 13 being as wide as the groove in the area of the guide channels 14. The guide channels 13 and 14 permit insertion of incoming and outgoing double-wire dropwire cables 9.

Further, centrally and laterally to the transverse axis of the basic body 1 of the cable connecting element, a substantially Z-shaped clamping groove 18 is arranged which have end areas at the guide channels 13 disposed at an angle of approximately 45°. Into the Z-shaped clamping groove 18, a Z-shaped connecting element 4 is inserted. The element 4 has a bar 5 which is arranged in the area of the clamping groove 18 and it has cutting and clamping contacts 6 and 7 arranged laterally to the longitudinal axis of the basic body 1 and each in the areas of the clamping groove 18 arranged and under an angle of 45° with respect to the guide channels 13. There are, displaced by approximately 90° with respect to the end areas of the Z-shaped clamping groove 18, provided accommodation grooves 15 in the basic body 1, being arranged at approximately 45° laterally with respect to the guide channels 13. Those accommodation grooves 15 serve for accommodation of those sections of the connecting element 4 which extend into the upper part 2 and which project above the lower part 3 of the basic body 1. The cutting and clamping contacts 6 and 7 of the Z-shaped connecting element 4 comprise each a clamping slot 8, the width of which is smaller than the diameter of the wires 11 and 12 of the double-wire dropwire cables 9.

The basic body 1 of the lower part 3 of the cable connecting element is provided on one longitudinal side with a recess 16 and on the other longitudinal side with a rib 17 shaped corresponding to the recess 16 and projects over the basic body 1 when placing the upper part 2 on the lower part 3, the rib 17 of one part engages into the recess 16 of the respective other part.

For connecting two double-wire dropwire cables 9, they are first bent into a U-shape at their free ends, and then they are inserted with their narrow sides 19 into the guide channels 13 and 14. The respective lower wires 11 of the two double-wire dropwire cables 9 lie, thus, above the clamping slots 8 of the Z-shaped connecting element 4 arranged in the lower part 3. After both double-wire dropwire cables 9 are inserted into the respective guide channels 13 and 14 of the lower part 3, the upper part 2 is placed upon the lower part. The upper part is of the same construction as the lower part 3 and it has a second Z-shaped connecting element 4. When placing the upper part 2, the insulations 10 of the respective lower wires 11 are cut, as shown in FIG. 3, by the cutting and clamping contacts 6 and 7 of the Z-shaped connecting element 4 arranged in the lower part 3, and the lower wires 11 are electically contacted and conductively connected to each other. Simultaneously, the insulations 10 of the upper wires 12 are cut by the cutting and clamping contacts 6 and 7 of the Z-shaped connecting element 4 arranged in the upper part 2, and the upper wires 12 are electrically contacted and electrically connected to each other. Both is effected, according to the invention, from the narrow side 19 of the double-wire dropwire cable 9. The cutting and clamping contacts 6 and 7 exhibit, for this, at the upper ends sharply constructed cutting edges 31 reducing the press-in forces.

As can be seen from the top view according to FIG. 1 in connection with the sectional representations according to the FIGS. 2 and 3, the two Z-shaped connecting elements 4 are arranged symmetrically to each other with respect to both the longitudinal and transverse axes of the basic body 1 and form an X-shape within the body 1. The cross bars 5 of the connecting elements 4 are of smaller height than their end parts with the cutting and clamping contacts 6 and 7 to prevent an electrical connection of the upper and lower connecting elements 4 to each other. When pressing upper and lower parts 2 and 3 together, the upper edges of the connecting elements 4 engage in the area of the cutting and clamping contacts 6 and 7 into the opposite accommodation grooves 15 of the respective other part.

By the U-shaped guiding of the ends of the double-wire dropwire cables 9, a cable strain relief is provided.

Figure 4:
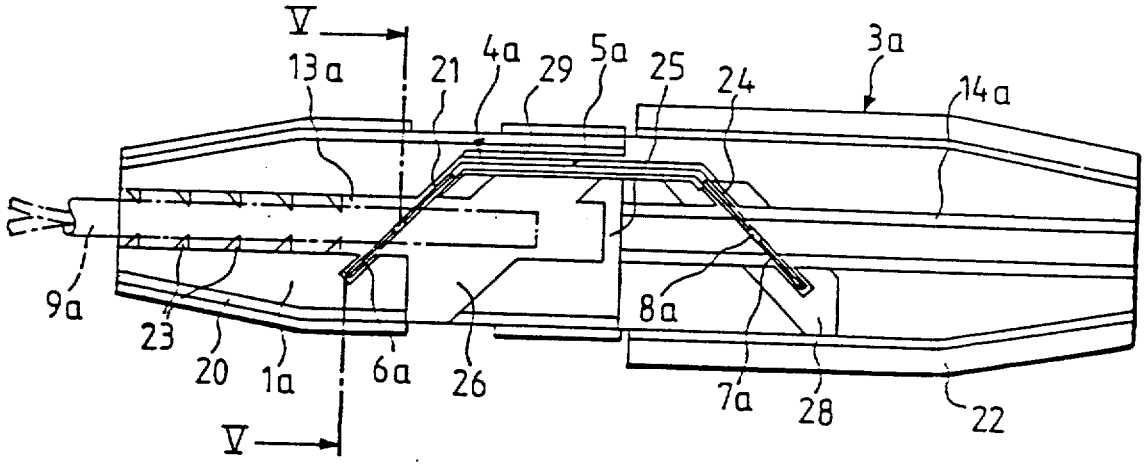
FIG. 4 is a top view of the lower part of a second embodiment of a cable connecting element.
Figure 5:
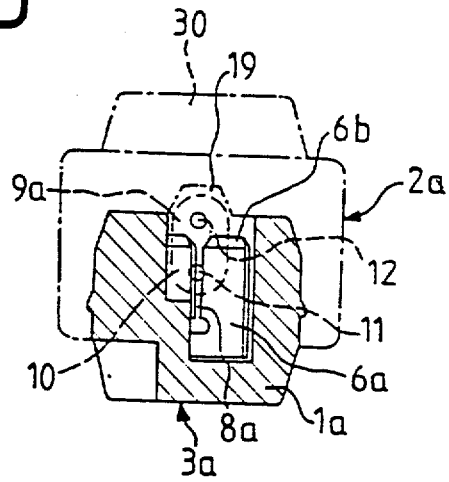
FIG. 5 is a section taken along the line V—V of FIG. 4 through the lower part with the upper part shown in dotted lines.

In FIGS. 4 and 5, the second embodiment of the cable connecting element is shown. It includes identical upper and lower parts 2*a* or 3*a*, respectively, such that, in the following, only the lower part 3*a* shown in FIG. 4 will be described in more detail. The lower part 3*a* comprises a basic body 1*a*, being of different design on the left and on the right of its cross axis. In the left side section (FIG. 4), the basic body 1*a* exhibits a guide channel 13*a* for the double-wire dropwire cable 9*a* standing upright on its narrow side 19. The guide channel 13*a* terminates before a central separating wall 25. In the guide channel 13*a*, clamping ribs 23 being opposed to each other are arranged on both side walls, said clamping ribs 23 providing for a strain relief of the double-wire dropwire cable 9*a* inserted in upright position. The basic body 1*a* is provided on the left side of FIG. 4 on both longitudinal sides with recesses 20. Near the separating wall 25, a wider recess 26 extending obliquely under an angle of approximately 45° is provided. In parallel to the recess 26 there is an accommodation groove 21 for a U-shaped connecting element 4*a* (to be described below) which extends at 45° to the guide channel 13*a*.

The basic body 1*a* exhibits in the right-side section of FIG. 4 a hollow space surrounded by outer side ribs 22, into which fits the section of the basic body 1*a* of the upper part 2*a* limited by the recesses 20.

Near the separating wall 25, a rib 28 extending under an angle of 45° to the longitudinal axis of the basic body 1*a* and interrupted by a guide channel 14*a* is arranged, said rib 28 being provided with an accommodation groove 24 extending under 45° to the longitudinal axis of the basic body 1*a* for accommodation of the U-shaped connecting element 4*a*. The rib 28 of the lower part 3*a* fits accurately into the recess 26 of the upper part 2*a*.

On one longitudinal side of the basic body 1*a*, in the area of the separating wall 25, a slot 29 extending longitudinally to the basic body 1*a* is provided, said slot 29 accommodating the cross bar 5*a* of the U-shaped connecting element 4*a*.

The U-shaped connecting element 4*a* exhibits in its two end areas angled under 45° with respect to the narrower cross bar 5*a* cutting and clamping contacts 6*a* and 7*a* with one clamping slot 8*a* each, the width of which being smaller than the diameter of the wires 11, 12 of the double-wire dropwire cable 9*a*.

When mounting the cable connecting element according to the second embodiment, first the incoming double-wire dropwire cable 9*a* is pressed with its narrow side 19 into the guide channel 13*a* of the lower part 3*a*, the clamping ribs 23 serving as strain relief. Correspondingly, the outgoing double-wire dropwire cable 9*a* is pressed with its narrow side 29 into the upper part 2*a* of the cable connecting element. Then, the upper and lower parts 2*a*, 3*a* are plugged upon each other and are pressed together, the cutting and clamping contacts 6*a*, 7*a* of the U-shaped connecting element 4*a* of the lower part 3*a* penetrating the insulations 10 of the lower wires 11 of the two double-wire dropwire cables 9*a*. Correspondingly, the cutting and clamping contracts 6*a*, 7*a* of the U-shaped connecting element 4*a* of the upper part 2*a* penetrate the insulation 10 of the upper wires 12 of the double-wire dropwire cables 9*a*. Then, the wires 11 or 12, respectively, of both double-wire dropwire cables 9, 9*a* are pressed into the cutting and clamping contacts 6*a*, 7*a* and are connected electrically over the respective connecting elements 4*a*. Here, too, cutting edges 31 are provided at the upper end of the cutting and clamping contacts 6*a*, 7*a* for reducing the press-in forces.

In the second embodiment according to the FIGS. 4 and 5, the two U-shaped connecting elements 4*a* are staggered over each other, because the connecting elements are not arranged centrally.

In both embodiments of the cable connecting element, the areas of the inner connecting element 4 and 4*a* are marked by outer ribs 30, 30*a* on the outer sides of the basic body 1, 1*a*. By the ribs 30, 30*a*, material saving is obtained, as the full height of the housing must not be reached.

The closed cable connecting elements can be completely filled with a gel.

While specific embodiments of the invention have been shown and described in detail to illustrate the application of the principles of the invention, it will be understood that the invention may be embodied otherwise without departing from such principles.

What is claimed is;

1. A cable connecting device for connecting incoming and outgoing double-wire dropwire cables having narrow top and bottom ends, comprising an upper and a lower part having two connecting elements with two spaced apart cutting and clamping contacts, each disposed in both said upper and lower parts, said upper and lower parts having guide channels of a size for accommodation of the double-wire dropwire cables narrow ends, a connecting element having two spaced apart cutting and clamping contacts in each of said upper and lower parts, said contacts each having a cutter penetrating into the narrow sides of both incoming and outgoing double-wire dropwire cables and contacting electrically their wires.

2. A cable connecting element according to claim 1, wherein said connecting element includes two spaced apart cutting and clamping elements interconnected by a cross bar and each of which are bent in an opposing manner in an angle of approximately 45°, such that a substantially Z-shaped connecting element is formed.

3. A cable connecting element according to claim 1, wherein said guide channels comprise a U-shaped channel formation capable of receiving an inserted drop wire cable in a manner so as to support the sides thereof.

4. A cable connecting element according to claim 1, wherein each connecting element has two cutting and clamping contacts which are bent under an angle of 45° with respect to each other, said connecting element being substantially U-shaped.

5. A cable connecting element according to claim 1, wherein said cutting and clamping elements comprises an upstanding cutter having a cutting edge capable of cutting away the insulation on each side of said wire.

6. A cable connecting element according to claim 1, wherein said guide channel is provided with clamping ribs for absorbing the strain of the wire when it is engaged therewith.

7. A device for electrically interconnecting two dropwire cables having narrow top and bottom edges and containing upper and lower contact wires arranged in the insulation of said cables one above the other between the upper and lower ends thereof, comprising a connecting body having top and bottom interengageable parts, at least one of said parts having an end opening for the entrance of at least two respective cables and a groove of a size to receive and hold a narrow end of the dropwire cable and position it in said connecting body, a connecting element extending from one groove for one cable to a groove for another cable to be connected thereto and having a cutting and connecting part extending upwardly to said groove for each cable with a central slot aligned in the groove so that it will be aligned with the wire of a cable lying in the groove and having cutting elements on each side which cut into the insulation of the overlying cable, the wire of one cable which is entrained in the slot being connected with the wire of the other cable which is entrained in the other slot.

8. A device according to claim 7, wherein said top part of said connecting body also has a similar connecting element with the cutting and connecting part of said similar element extending downwardly to penetrate the insulation of the top of the cable to be connected and so as to engage the upper wire of the dropwire cable with the connecting element so as to electrically interconnect the top wires of the two cables together.

9. A device according to claim 8, wherein said connecting element comprises a portion which intercepts the slot which at substantially a 45° angle with the axis of the slot.

10. A device according to claim 7, wherein the groove comprises a substantially straight portion and a rounded portion extending back upon itself for each cable forming an overall configuration which is substantially like the numeral 8 and wherein said connecting element includes a straight portion extending across the straight portion of said groove and an angle portion extending at an angle over the remaining portion of said groove.

11. A device according to claim 7, wherein said groove is a substantially straight groove having an opening at each end of said connecting portion for a respective cable.

12. A method of electrically connecting two electrical dropwire cables each of which have a narrow top and bottom end with upper and lower contact wires arranged in insulation of said dropwire cables one above the other between the upper and lower ends, and using a connecting body having upper and lower interengaging parts each of which has a connecting element with two spaced apart upstanding electrically conductive cutting and connecting elements having cutting edges capable of cutting through the insulation of the cable and including a vertically extending receiving slot of a width smaller than the diameter of the contact wires, comprising placing the two dropwire cables into the connecting body so that each is oriented over and pressed against the respective cutting edge so as to effect the cutting of the insulation and to position the cutting wire into the associated receiving slot and thereby to cause the wire of each cable which is to be connected to the wire of the other cable to enter the slot and make contact with the cutting and connecting elements become electrically connected together.

13. A method according to claim 12, including placing the upper part over the lower part to thereby cause electrical connection of the upper wires of one cable with the upper wire of the other cable.

* * * * *

UNITED STATES PATENT AND TRADEMARK OFFICE

CERTIFICATE OF CORRECTION

PATENT NO. : 4,775,330

DATED : October 4, 1988

INVENTOR(S) : Heide Teichler et al

It is certified that error appears in the above-identified patent and that said Letters Patent is hereby corrected as shown below:

Insert figures 4 and 5 as part of Letters Patent as shown on the attached sheet.

Signed and Sealed this

Twenty-first Day of November, 1989

*Attest:*

JEFFREY M. SAMUELS

*Attesting Officer* *Acting Commissioner of Patents and Trademarks*